US007827715B2

(12) United States Patent
Thissen

(10) Patent No.: US 7,827,715 B2
(45) Date of Patent: Nov. 9, 2010

(54) MULTI-DIRECTIONAL HAND-HELD SIGN

(76) Inventor: Frank Thissen, 122 Helen Ct., Franklin Lakes, NJ (US) 07417

( * ) Notice: Subject to any disclaimer, the term of this patent is extended or adjusted under 35 U.S.C. 154(b) by 94 days.

(21) Appl. No.: 12/220,051

(22) Filed: Jul. 21, 2008

(65) Prior Publication Data

US 2009/0019746 A1 Jan. 22, 2009

Related U.S. Application Data

(60) Provisional application No. 60/951,046, filed on Jul. 20, 2007.

(51) Int. Cl.
*G09F 21/02* (2006.01)

(52) U.S. Cl. ..... 40/586; 40/610; 40/612; 116/63 P

(58) Field of Classification Search ..... 40/586, 40/606.18, 612, 729, 610; 434/101, 174, 434/402; 446/266; 116/63 P
See application file for complete search history.

(56) References Cited

U.S. PATENT DOCUMENTS 2,499,535 A * 3/1950 Spreen ..... 40/729
2,849,816 A 9/1958 Locke
3,594,936 A * 7/1971 Blum ..... 40/124.19
3,911,854 A * 10/1975 Manuel ..... 116/63 P
4,117,455 A * 9/1978 Cervantes ..... 340/908
4,203,239 A * 5/1980 Williams et al. ..... 40/761
D267,158 S 12/1982 Lopez
5,301,435 A * 4/1994 Buckley ..... 33/293
5,375,355 A * 12/1994 Rhoads ..... 40/607.11
D358,176 S * 5/1995 Atkinson ..... D20/21
5,433,036 A * 7/1995 Ganal ..... 40/729
5,572,188 A * 11/1996 McDowell, II ..... 340/473
5,694,110 A * 12/1997 Clifford ..... 340/321
6,134,819 A * 10/2000 McClain et al. ..... 40/586
6,385,886 B1 * 5/2002 Chepikian ..... 40/729
6,519,884 B1 2/2003 Duhamel
6,530,338 B2 * 3/2003 Okumura et al. ..... 116/173
2006/0031002 A1 2/2006 Haney

* cited by examiner

*Primary Examiner*—Lesley Morris
*Assistant Examiner*—Christopher E Veraa
(74) *Attorney, Agent, or Firm*—James Ray & Assoc

(57) ABSTRACT

A multi-sided hand-held sign includes two substantially planar panels having a preselected shape interlocking substantially perpendicularly at a common central vertical axis and held in position partly by a handle for engaging with and holding the sign panels. Indicia typical of signs held by school crossing guards are disposed on all the planar surfaces of the planar sign panels, and a slotted top end cap is engageable with the top horizontal edges of the planar sign panels.

15 Claims, 5 Drawing Sheets

MULTI-DIRECTIONAL HAND-HELD SIGN

CROSS REFERENCE TO RELATED APPLICATION

This patent application is related to and claims priority from U.S. Provisional Patent Application Ser. No. 60/951,046 filed Jul. 20, 2007.

FIELD OF THE INVENTION

The present invention relates, in general, to hand-held signs and, more particularly, this invention relates to signs that can be read from more than two directions simultaneously.

BACKGROUND OF THE INVENTION

Prior to the conception and development of the present invention, people, such as school crossing guards or flagmen, have been holding signs to warn or direct those approaching. Typically their warning signs can only be seen from two directions. In some instances, it would be advantageous to have the warning message visible from more than two directions at the same time. However, there is very little in the prior art to address this need. In U.S. Pat. No. 2,849,816, Locke discloses a traffic control sign with a smaller replica on top of and perpendicular to the main sign. Traffic approaching perpendicular to the road controlled by the main sign is not expected to respond to the small sign, so the coloring is not standard and indicia may be omitted. U.S. Design Pat. No. Des 267,158 illustrates multiple cubes on a pole with traffic control signs or symbols on multiple surfaces of these cubes. The signs and symbols would only be readable from a short distance away. U.S. Patent Application 2006/0031002 discloses a school crossing guard security system capable of displaying images on four sides. It is electrically powered and designed for mounting on permanent poles, and it would not be practical as a hand-held sign for crossing guards.

SUMMARY OF THE INVENTION

The present invention provides a multi-sided hand-held sign, and includes two substantially planar panels having a preselected shape interlocking substantially perpendicularly at a common central vertical axis and held in position partly by a handle for engaging with and holding the sign panels. Indicia typical of signs held by school crossing guards are disposed on all the planar surfaces of the planar sign panels, and a slotted top end cap is engageable with the top horizontal edges of the planar sign panels.

In an alternative embodiment, one sign panel is cut vertically into two equal halves which are then mounted perpendicular to the other sign panel and held in position by the handle and other means. In a most preferred embodiment, the two equal halves can fold down to a two-way sign for easier transport and storage, and then be rotated out to a four-way version using a rod and sleeve arrangement.

OBJECTS OF THE INVENTION

It is, therefore, one of the primary objects of the present invention to provide a hand-held sign that can be read from at least four directions simultaneously.

Another object of the present invention is to provide a lightweight stop sign for crossing guards to hold so that motorists approaching from four directions can all see it at the same time.

Still another object of the present invention is to provide a hand-held sign that would give advance warning to vehicles about to turn onto a street where children are crossing.

Yet another object of the present invention is to provide a multi-sided sign that can utilize the standard octagonal shape of stop signs.

An additional object of the present invention is to provide a hand held sign that can be two-sided for transport and storage, but also can be opened to a four-way sign as desired.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
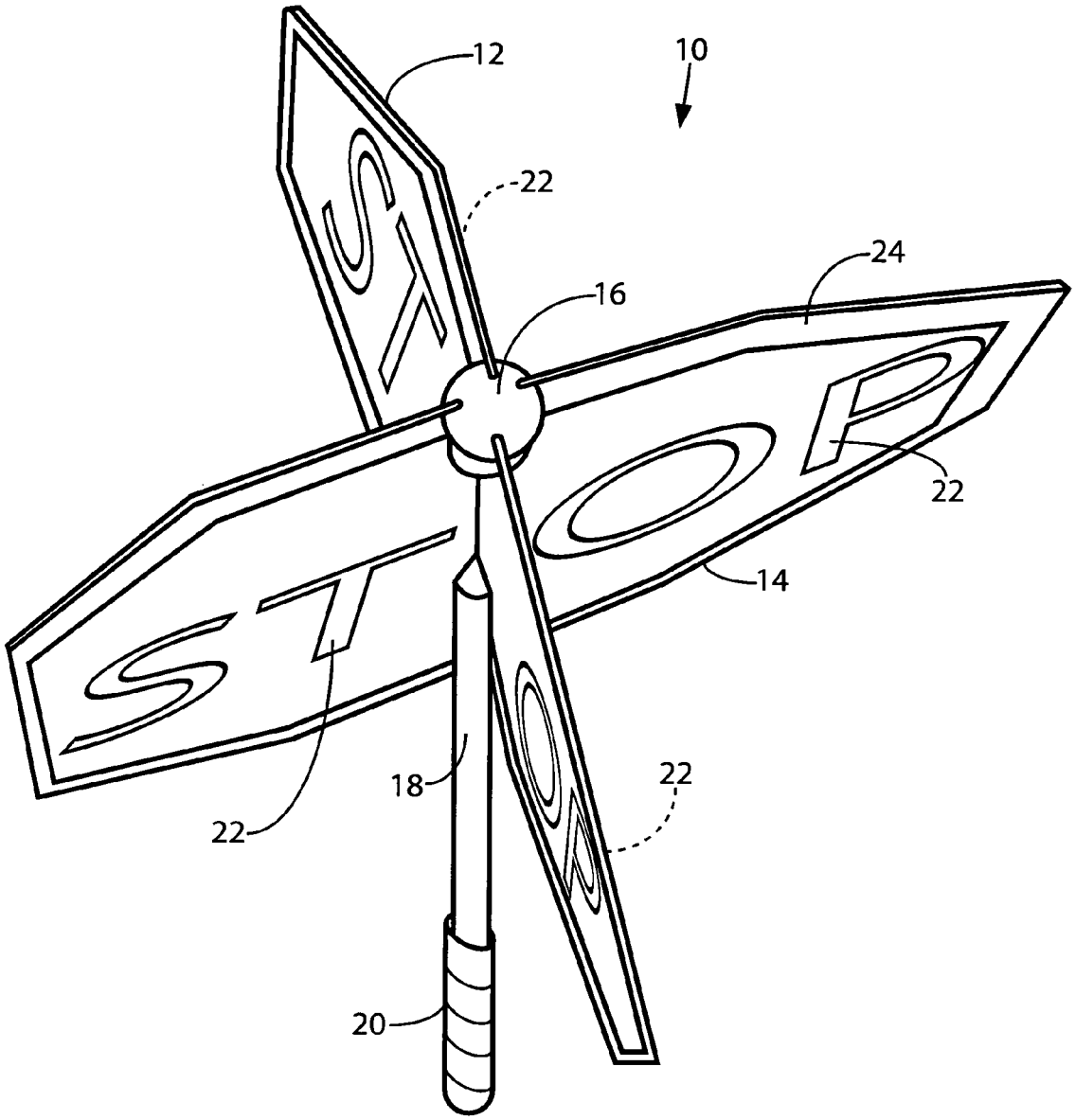
FIG. 1 is a perspective topside view of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, a four sided stop sign, generally indicated at 10, is depicted in a downward-looking perspective view. Two lightweight octagonal sign panels, 12 and 14, are interlocked substantially perpendicularly and held in position by a top cap 16. The panels will preferably be a common thin foamboard coated with the appropriate color scheme and indicia 22. Most typically, it will be the letters 22 spelling STOP on a red background with a white border 24, but other shapes and lettering can be employed. Opposite the top cap is a pole 18 that also helps to hold the panels 12 and 14 in a perpendicular relationship. A hand grip 20 is an option for the opposite end of pole 18. The pole 18 can be constructed of either wood, plastic, or metal.

Figure 2:
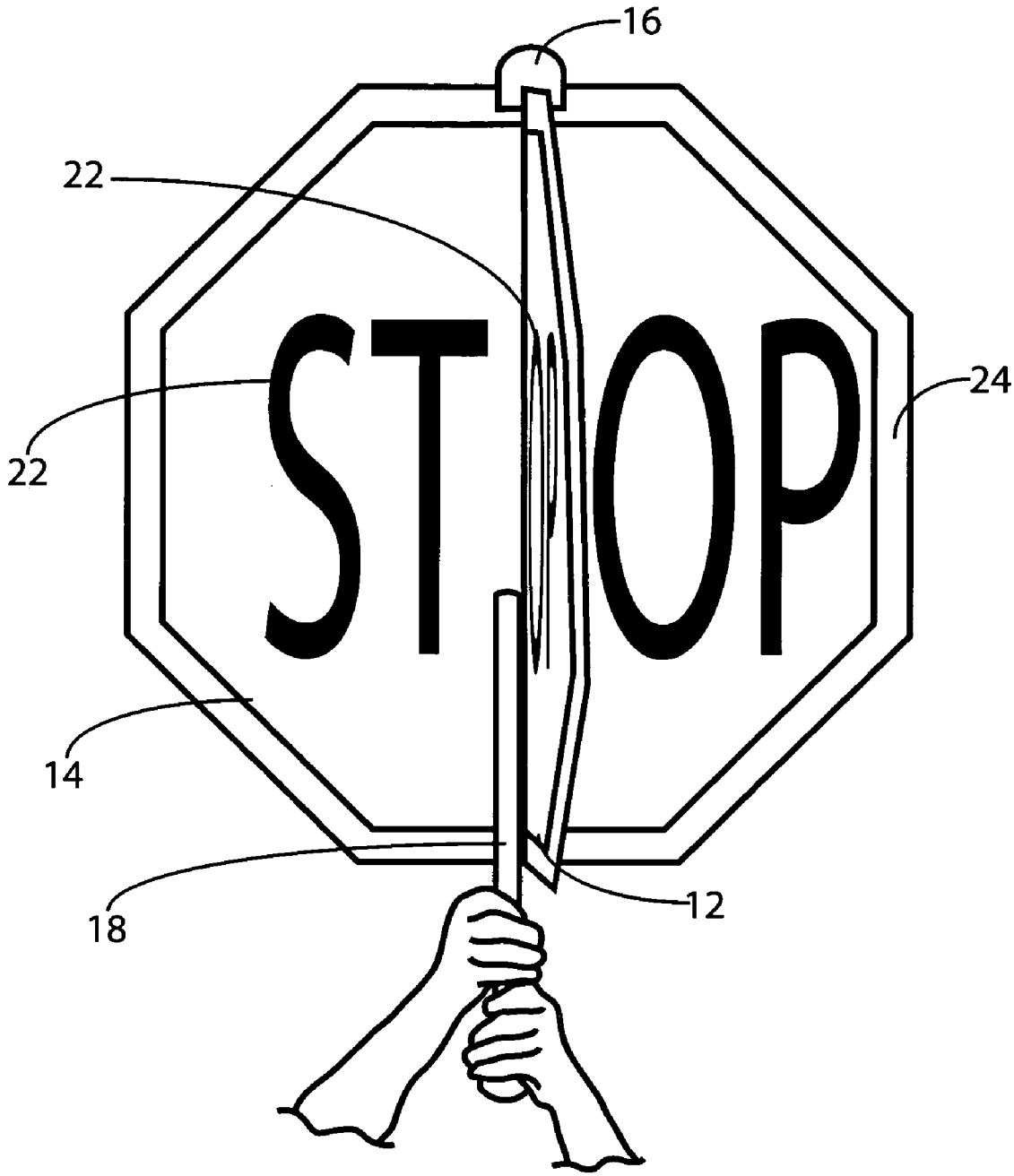
FIG. 2 is a perspective elevation view of the present invention.

FIG. 2 illustrates the use of the four-way sign hand held by a school crossing guard. The handle 18 allows the user to hold the sign while also keeping the sign panels 12 and 14 perpendicular. A top cap 16 also helps to retain the panels in the desired position. The lettering or indicia 22 are printed on both sides of each panel, but need not be identical words. A significant advantage of this intersecting panel design is that the standard octagonal shaped stop sign can be employed.

Figure 3:
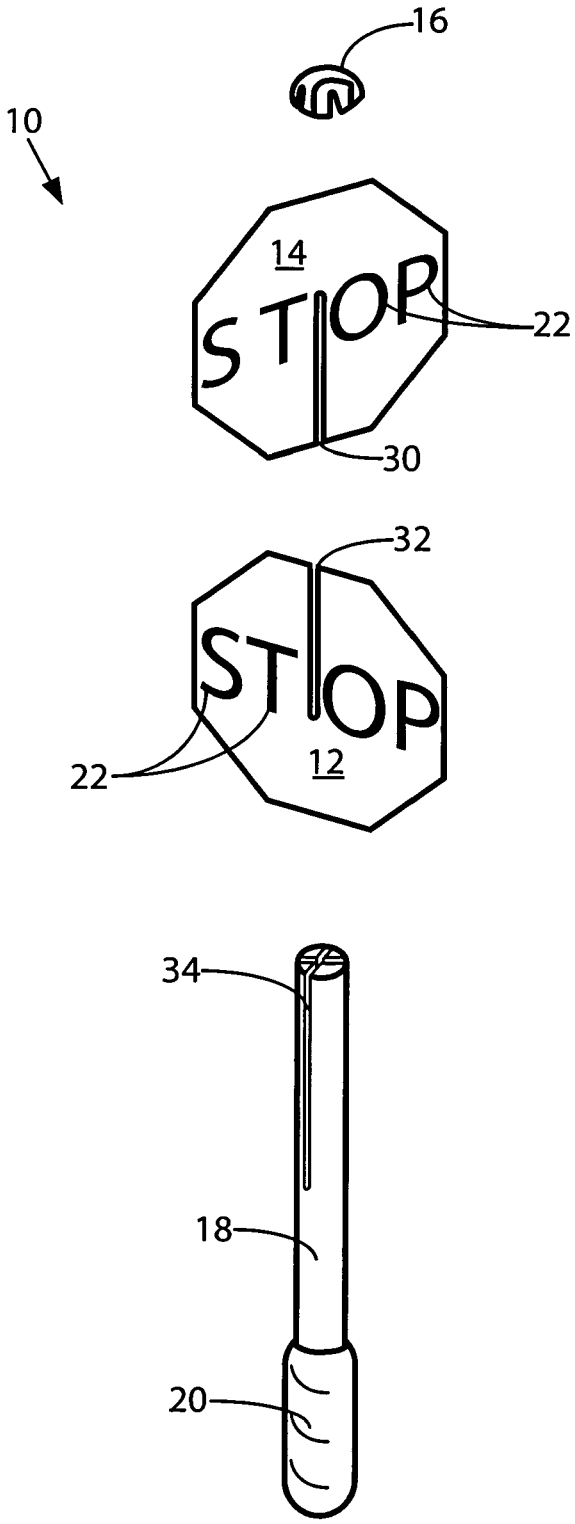
FIG. 3 is an exploded perspective view of an alternative embodiment of the invention.

FIG. 3 provides an exploded perspective view of the preferred mode of assembling the four-way sign. The sign panels 12 and 14 have slots 30 and 32 extending about half the panel width across from either a top or bottom edge to the center of the panels 14 or 12 respectively. The slots 30 and 32 run parallel to the axis of the lettering and start from opposing edges. The slot width is slightly greater than the thickness of the panels 12 and 14. Once assembled, a slotted top cap 16 helps to retain the perpendicular relationship of the panels. The slotted handle 18 further aids in maintaining the desired positions when the bottom center portions of the panels 12 and 14 are slid into the perpendicular axial slots 34.

Figure 4:
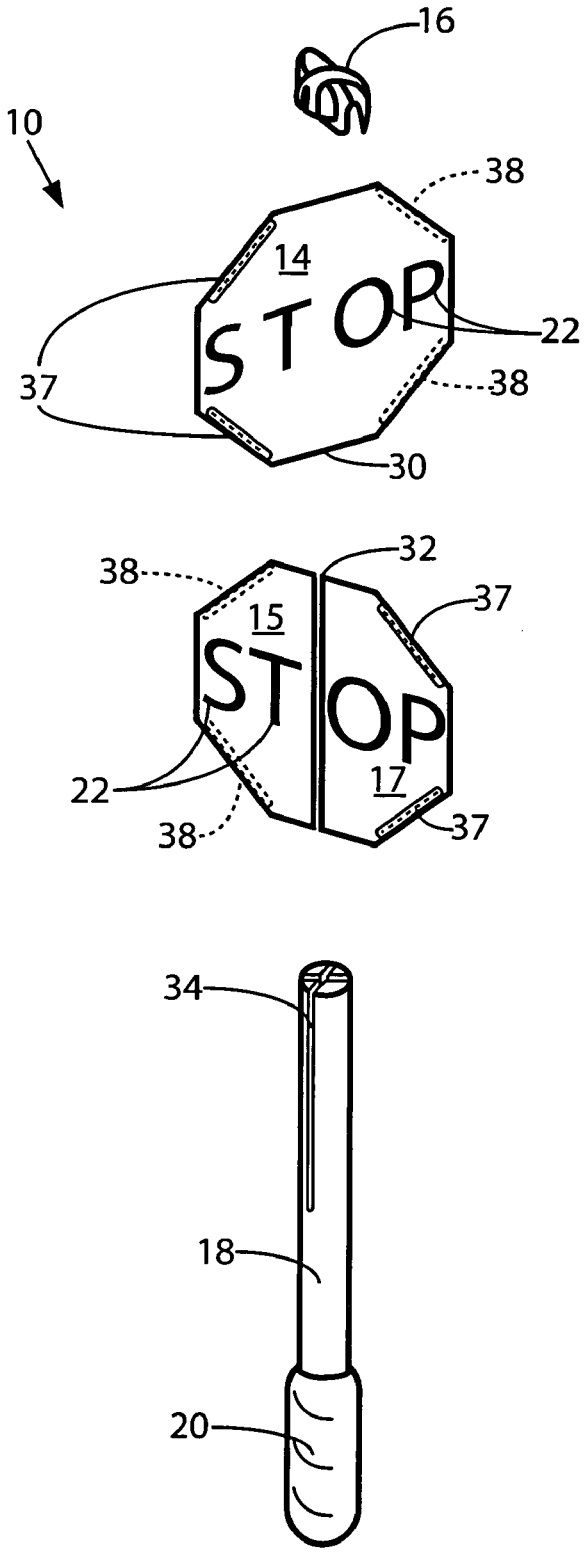
FIG. 4 is an exploded perspective view of an alternative embodiment of the invention.

FIG. 4 provides an exploded perspective view of an alternative mode 10 of assembling the four-way sign. In this alternative design, un-slotted sign panels would be utilized, and one of the panels is cut top to bottom through the center. The two halves of the cut panel, 15 and 17 would then be held in perpendicular position to the other panel 14 by the slotted top cap 16 and axial grooves of slots 34 in the handle 18. For transport and use as just a two way sign, border areas of both the two halves 15 and 17 and full sign 14 would have appropriately placed strips of adhesive-backed hook and loop fastener (Velcro®) such that the halves 15 and 17 could be held against opposite sides of the full panel 14 and the letters 22 would still be in the proper position to read the desired word. To convert to a four-way sign, the top cap 16 is removed, then the halves 15 and 17 are peeled off and individually slid into the grooves 34 in the handle 18, and finally the top cap 16 engaged with all three panels at the top to add support for the perpendicular position. In a less preferred but acceptable mode of handle construction, four pieces of quarter-round molding could be positioned in the four 90-degree angles formed by the sign panels 12 and 14, and the molding pieces then banded together below the sign. As an option, a hand grip 20 encases the distal end of the handle 18.

Figure 5:
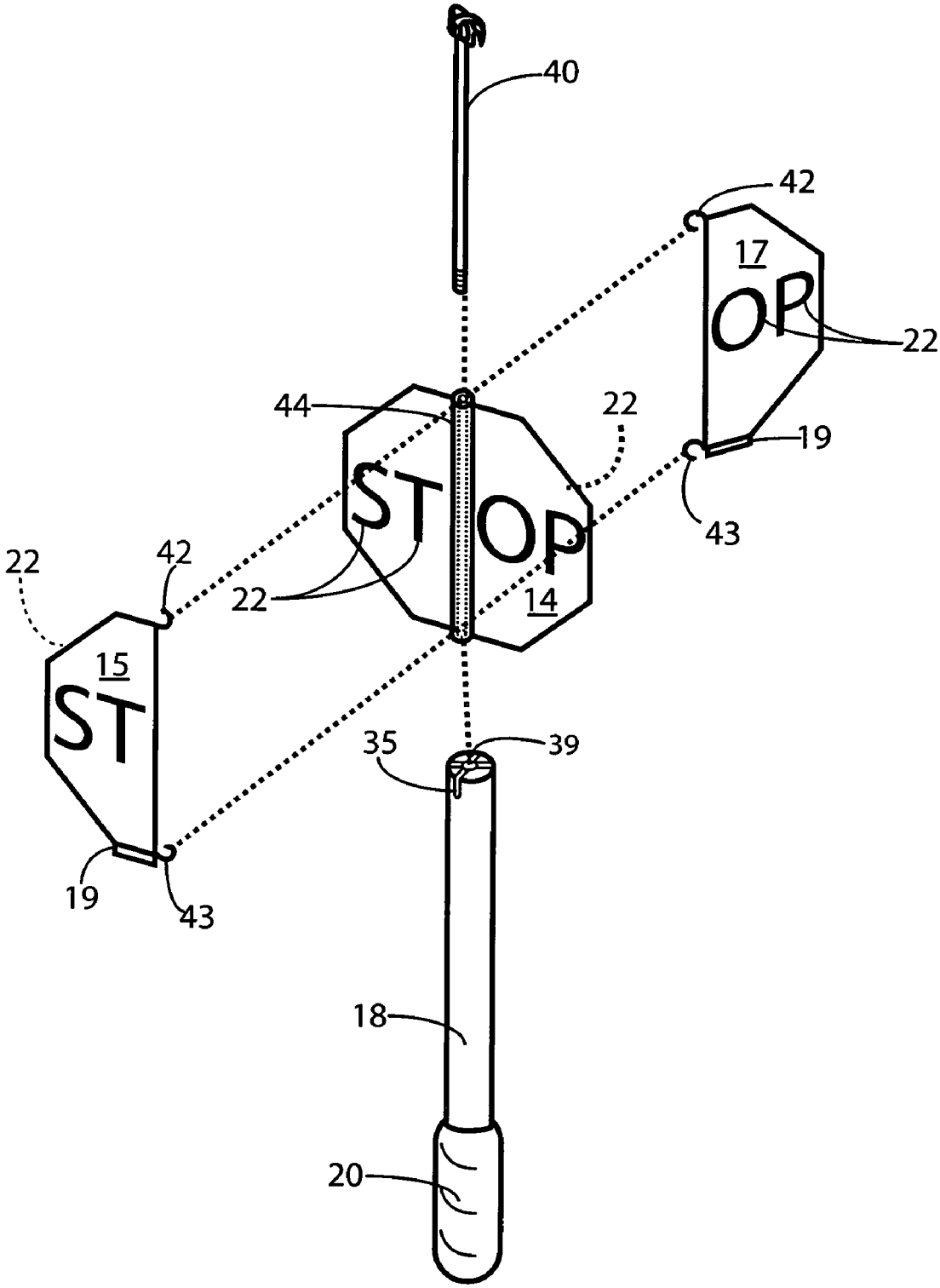
FIG. 5 is an exploded perspective view of a preferred embodiment of the present invention.

FIG. 5 provides a preferred embodiment of the present invention in an exploded perspective view. This variation folds down for easy transport and use as a two-sided sign, and folds open for use as a four-way sign. A first one-piece sign panel 14 has a hollow sleeve 44 through the vertical axis and indicia 22 on both sides. Two halves of a second sign panel, 15 and 17, have optional short bottom extensions 19 of about one-quarter to one-half inch for engagement with notches 35 in the sign handle 18. The sign halves 15 and 17 also have top and bottom eye rings 42 and 43 adjacent the center edge and spaced one to ten millimeters further apart than the length of the hollow sleeve 44. For assembly, the eye rings 42 and 43 are placed in line with above and below the central sleeve 44 and a threaded rod 40 then joins the three sign pieces by threading in order through the top eye rings 42, then the hollow sleeve 44, followed by the lower eye rings 43, and finally into the mating threaded section 39 in handle 18. The rod 40 can then be tightened, but the panel halves 15 and 17 should still be able to rotate freely and be lifted slightly. The halves 15 and 17 will normally be held essentially parallel to opposite sides of the one piece panel 14 for storage, transport, and use as a two-sided sign. For four-way use, it is opened up and the bottom extensions 19 are engaged into notches 35 in the handle 18. Alternatively, the top eye rings 42 are split and the bottom eye ring is common to both panels 15 and 17 and holds them together at the bottom. The eye ring 43 is large enough in diameter to permit the sleeve 43 to slide between the two halves 15 and 17 while the top rings 42 are separated. The rod 40 then goes through the sleeve 44, engages with the top rings 42, then with the bottom ring 43 and finally screws into the handle 18 at 38. The rod 40 engagement at the handle 18 at aperture 38 could also be a friction fit.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A multi-sided hand-held sign comprising:

a) two substantially planar sign panels having a preselected shape interlocking substantially perpendicularly at a common central vertical axis of said planar sign panels;

b) a handle means of a predetermined material engageable with said planar sign panels in order to secure said planar sign panels together and to provide a gripping zone;

c) indicia disposed on planar surfaces of said planar sign panels; and d) a slotted top end cap engageable with top horizontal edges of said planar sign panels.

2. The multi-sided hand-held sign, according to claim 1, wherein said handle means is an elongated member having perpendicular intersecting slots extending axially from a non-gripping end along a portion of said elongated handle.

3. The multi-sided hand-held sign, according to claim 1, wherein said predetermined material of said handle means is one of wood, plastic, and metal.

4. The multi-sided hand-held sign, according to claim 1, wherein said indicia spell out "STOP".

5. The multi-sided hand-held sign, according to claim 1, wherein said preselected shape of said planar sign panels is that of an octagon.

6. The multi-sided hand-held sign, according to claim 1, wherein said planar sign panels each have opposing vertical slots about half way through and along central axes.

7. The multi-sided hand-held sign, according to claim 1, wherein one of said two planar sign panels is vertically divided and each half is secured substantially perpendicular to other panel by said handle means and said slotted top end cap.

8. A multi-sided hand-held sign comprising:

a) one substantially planar sign panel having a preselected shape with an integral sleeve at a central vertical axis;

b) a removable rod having a head and a tip zone at an end opposite said head, wherein said removable rod has a diameter less than an internal diameter of said integral sleeve;

c) two substantially planar sign panel halves forming substantially said preselected shape when abutted along a vertical edge in a common plane;

d) rotatable connecting means adjacent top and bottom corners of central edges of said two planar sign panel halves for engagement with said removable rod adjacent ends of said integral sleeve;

e) a handle means of a predetermined material providing a gripping zone and having an internal axial cavity zone engaging with said removable rod in order to secure said planar sign panels to said handle means; and f) indicia disposed on planar surfaces of said planar sign panels.

9. The multi-sided hand-held sign, according to claim 8, wherein said preselected shape of said planar sign panel is that of an octagon.

10. The multi-sided hand-held sign, according to claim 8, wherein said rotatable connecting means are partial rings interlocking with limited rotation.

11. The multi-sided hand-held sign, according to claim 8, wherein said removable rod is threaded in at least said tip zone.

12. The multi-sided hand-held sign, according to claim 8, wherein said axial cavity includes a threaded zone mating with threads on said tip zone of said removable rod.

13. The multi-sided hand-held sign, according to claim 8, wherein said planar sign panel halves further include bottom edge tabs for engaging in notches in said handle means.

14. The multi-sided hand-held sign, according to claim 8, wherein said indicia spell out "STOP".

15. The multi-sided hand-held sign, according to claim 8, wherein said predetermined material is one of plastic, wood, and metal.

* * * * *